US011035068B2

(12) United States Patent
Wee et al.

(10) Patent No.: US 11,035,068 B2
(45) Date of Patent: Jun. 15, 2021

(54) WASHING MACHINE

(71) Applicant: Samsung Electronics Co., Ltd, Gyeonggi-do (KR)

(72) Inventors: Hoon Wee, Gyeonggi-do (KR); In Cheol Jang, Gyeonggi-do (KR); Jeoung Kyo Jeoung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/509,190

(22) PCT Filed: Aug. 11, 2015

(86) PCT No.: PCT/KR2015/008383
§ 371 (c)(1),
(2) Date: Mar. 6, 2017

(87) PCT Pub. No.: WO2016/036021
PCT Pub. Date: Mar. 10, 2016

(65) Prior Publication Data

US 2017/0260678 A1 Sep. 14, 2017

(30) Foreign Application Priority Data

Sep. 5, 2014 (KR) ..... 10-2014-0118853

(51) Int. Cl.
*D06F 37/26* (2006.01)
*D06F 39/14* (2006.01)
(Continued)

(52) U.S. Cl.
CPC ..... *D06F 37/266* (2013.01); *D06F 23/02* (2013.01); *D06F 34/28* (2020.02); *D06F 37/04* (2013.01);
(Continued)

(58) Field of Classification Search
CPC ..... D06F 37/266; D06F 37/267; D06F 37/25; D06F 37/265; D06F 39/14; D06F 37/04;
(Continued)

(56) References Cited

U.S. PATENT DOCUMENTS 6,582,276 B1 * 6/2003 Bao ..... A63H 33/3061 446/236
6,910,286 B2 * 6/2005 Hwang ..... D06F 58/04 34/601
(Continued)

FOREIGN PATENT DOCUMENTS

DE 102006054103 B3 12/2007
KR 1020040048194 A 6/2004
(Continued)

OTHER PUBLICATIONS

International Search Report dated Oct. 28, 2015 in connection with International Application No. PCT/KR2015/008383, 3 pages.
(Continued)

*Primary Examiner* — Kimberley S Wright

(57) ABSTRACT

Disclosed is a washing machine from which a diaphragm is removed. The washing machine includes a cabinet, a front panel configured to form an appearance of a front surface of the cabinet, a tub disposed in the cabinet to contain wash water, a tub seal installed to prevent leakage of the wash water contained in the tub, and a decorative panel fixed to the front panel to prevent exposure of the tub seal through the front surface of the cabinet. The washing machine may have an attractive appearance appealing to a user by mounting the decorative panel to prevent exposure of a sealing structure through the front surface thereof.

12 Claims, 8 Drawing Sheets

(51) Int. Cl.

| | |
|---|---|
| ***D06F 34/28*** | (2020.01) |
| ***D06F 23/02*** | (2006.01) |
| ***D06F 37/04*** | (2006.01) |
| ***D06F 37/22*** | (2006.01) |
| ***D06F 37/30*** | (2020.01) |
| ***D06F 39/08*** | (2006.01) |
| *D06F 39/12* | (2006.01) |

(52) U.S. Cl.
CPC ..... *D06F 37/22* (2013.01); *D06F 37/304* (2013.01); *D06F 39/085* (2013.01); *D06F 39/088* (2013.01); *D06F 39/14* (2013.01); *D06F 39/12* (2013.01)

(58) Field of Classification Search
CPC ..... D06F 37/22; D06F 37/304; D06F 39/085; D06F 39/088; D06F 23/02; D06F 34/28
See application file for complete search history.

(56) References Cited

U.S. PATENT DOCUMENTS 6,931,761 B2 * 8/2005 Hwang ..... D06F 58/04 34/601
7,024,801 B2 * 4/2006 Hwang ..... D06F 58/04 34/603
7,357,006 B2 * 4/2008 Kim ..... D06F 37/266 68/139
7,571,626 B2 * 8/2009 Choi ..... D06F 37/266 68/196
7,581,412 B2 * 9/2009 Kim ..... D06F 37/266 68/23 A
7,748,243 B2 * 7/2010 Park ..... D06F 39/12 312/228
8,167,385 B2 * 5/2012 Park ..... D06F 39/12 312/204
8,746,017 B2 * 6/2014 Huerth ..... D06F 39/14 68/140
9,260,812 B2 * 2/2016 Moon ..... D06F 25/00
9,340,917 B2 * 5/2016 Carrillo ..... D06F 37/266
9,637,855 B2 * 5/2017 Buso ..... D06F 37/266
9,732,459 B2 * 8/2017 Kim ..... D06F 37/266
2003/0110817 A1 6/2003 Nitschmann et al.
2003/0172689 A1 * 9/2003 Fitton ..... D06F 37/266 68/12.26
2004/0103556 A1 * 6/2004 Bang ..... D06F 58/26 34/595
2004/0159009 A1 * 8/2004 Hwang ..... D06F 58/04 34/601
2004/0159010 A1 * 8/2004 Hwang ..... D06F 58/04 34/601
2004/0163275 A1 * 8/2004 Hwang ..... D06F 58/04 34/601
2004/0163426 A1 * 8/2004 Kim ..... D06F 37/266 68/23 A
2005/0178169 A1 * 8/2005 Kim ..... D06F 37/266 68/23.1
2006/0174663 A1 * 8/2006 Cimetta ..... D06F 37/266 68/3 R
2006/0254319 A1 * 11/2006 Park ..... D06F 37/266 68/3 R
2006/0255700 A1 * 11/2006 Park ..... D06F 39/08 312/228
2007/0044521 A1 * 3/2007 Choi ..... D06F 37/266 68/140
2007/0130790 A1 * 6/2007 Jung ..... D06F 58/04 34/242
2007/0256459 A1 * 11/2007 Yoon ..... D06F 37/28 68/139
2008/0141558 A1 * 6/2008 Bae ..... D06F 58/203 34/595
2009/0033185 A1 * 2/2009 Park ..... D06F 39/12 312/228
2009/0066205 A1 * 3/2009 Park ..... D06F 39/005 312/228
2010/0026015 A1 * 2/2010 Joerger ..... D06F 37/28 292/254
2011/0285260 A1 * 11/2011 Moon ..... D06F 25/00 312/228
2012/0024018 A1 * 2/2012 Huerth ..... D06F 37/266 68/140
2013/0057130 A1 * 3/2013 Kim ..... D06F 37/266 312/228
2013/0152641 A1 * 6/2013 Carrillo ..... D06F 37/266 68/12.26
2013/0192084 A1 * 8/2013 Hill ..... D06F 35/008 34/427

FOREIGN PATENT DOCUMENTS

KR 1020060040338 A 5/2006
KR 100692556 B1 3/2007
KR 1020070025303 A 3/2007
KR 1020080086773 A 9/2008
WO 0200988 A1 1/2002
WO WO-2005014913 A1 * 2/2005 ..... D06F 37/28

OTHER PUBLICATIONS

Written Opinion of the International Searching Authority dated Oct. 28, 2015 in connection with International Application No. PCT/KR2015/008383, 10 pages.
Extended European Search Report and European Search opinion for European Patent Application No. 15838471.9 dated Apr. 11, 2018; 6 pages.
Communication pursuant to Article 94(3) EPC dated Apr. 9, 2020 in connection with European Patent Application No. 15 838 471.9, 8 pages.
Office Action dated Sep. 8, 2020 in connection with Korean Patent Application No. 10-2014-0118853, 10 pages.

* cited by examiner

[Fig. 1]
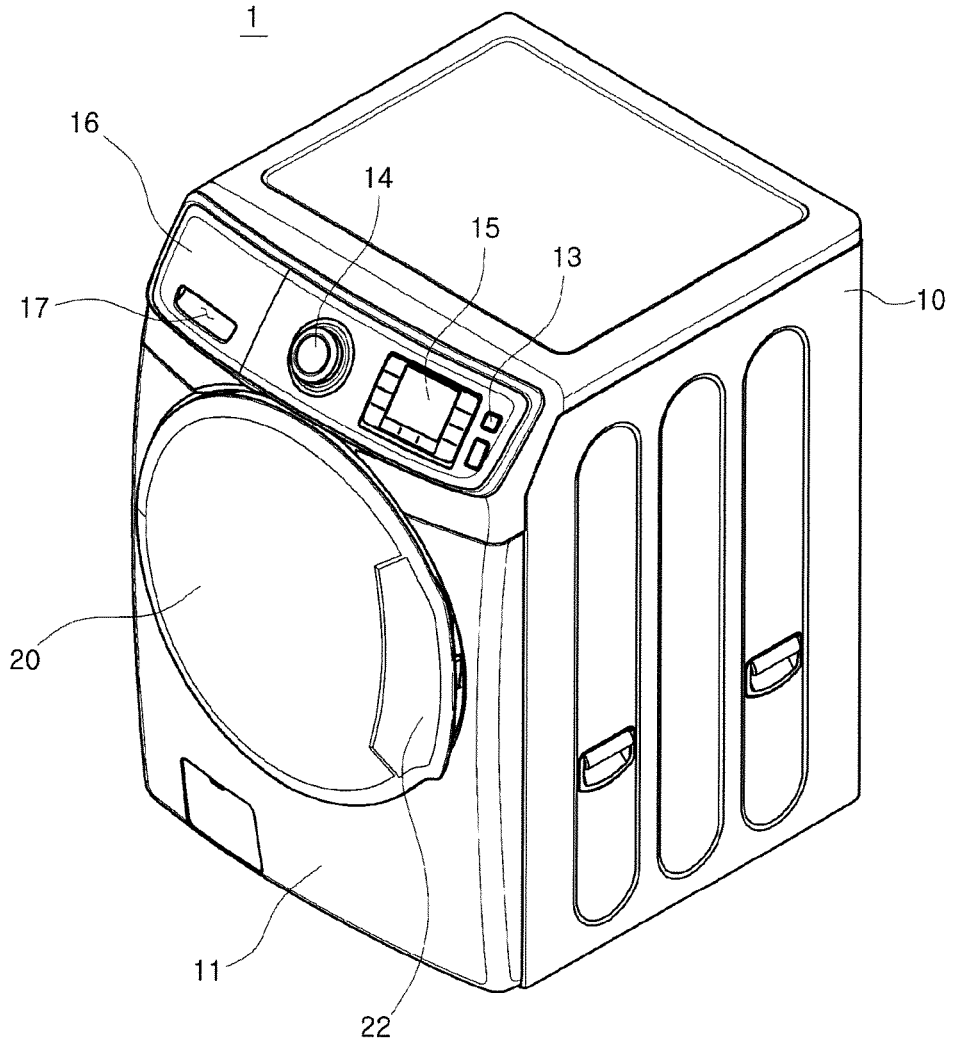

[Fig. 2]
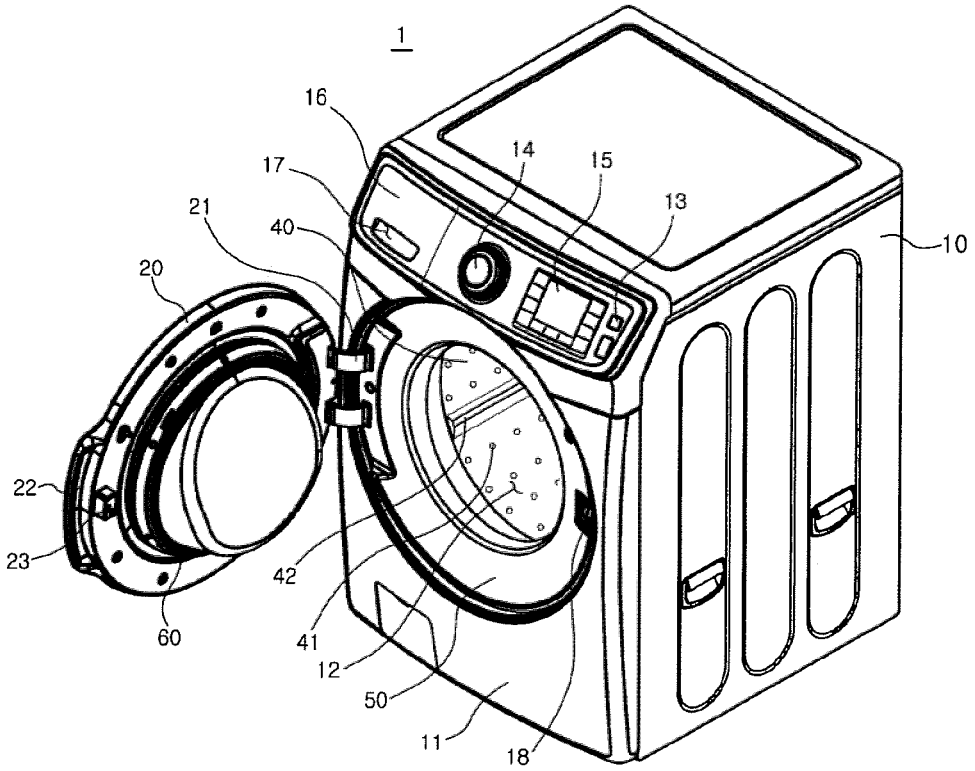

[Fig. 3]
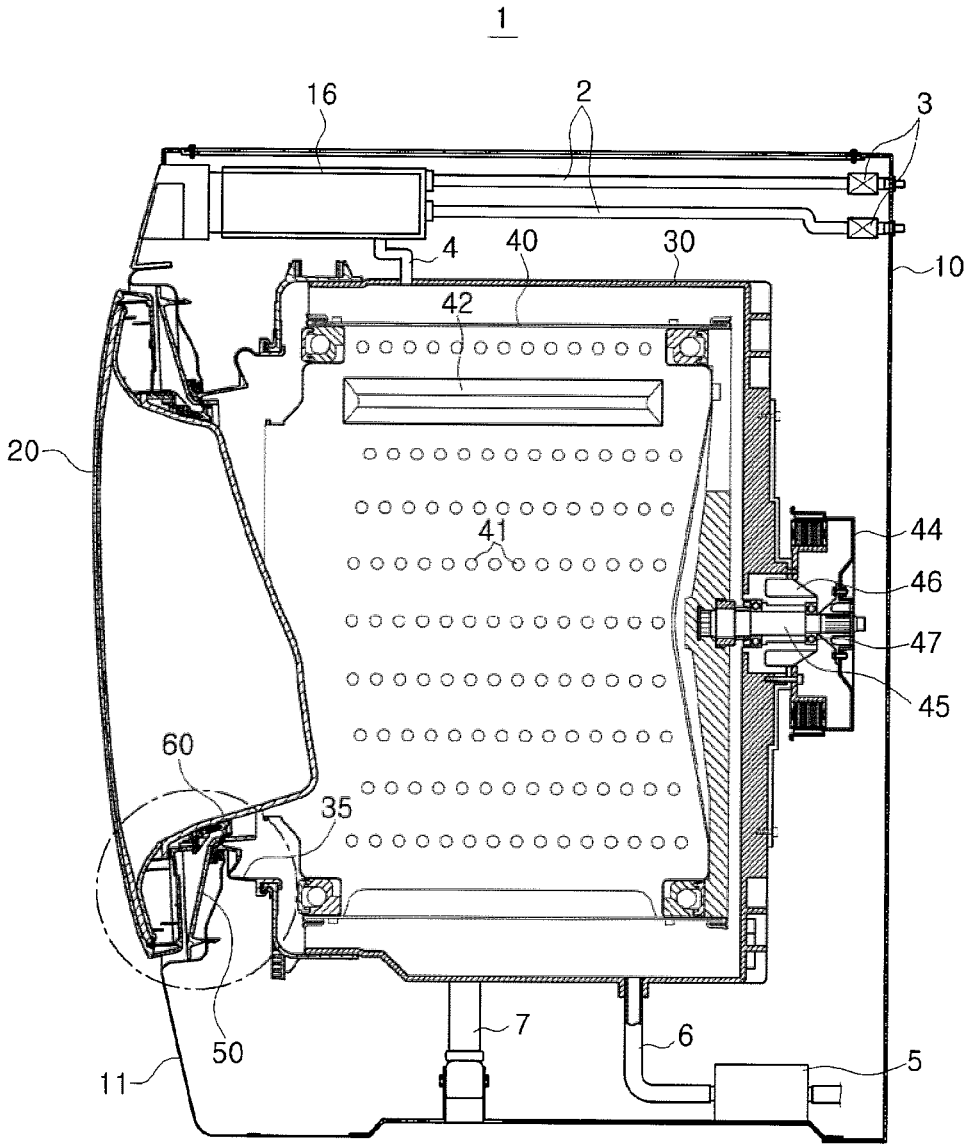

[Fig. 4]
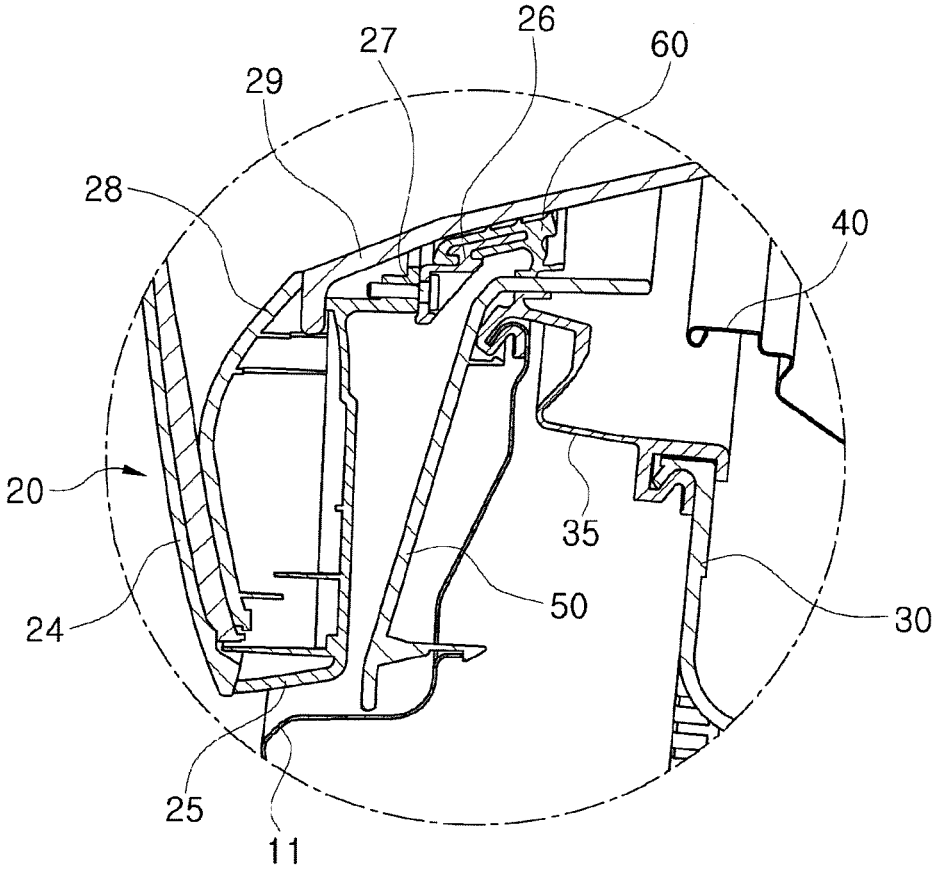

[Fig. 5]
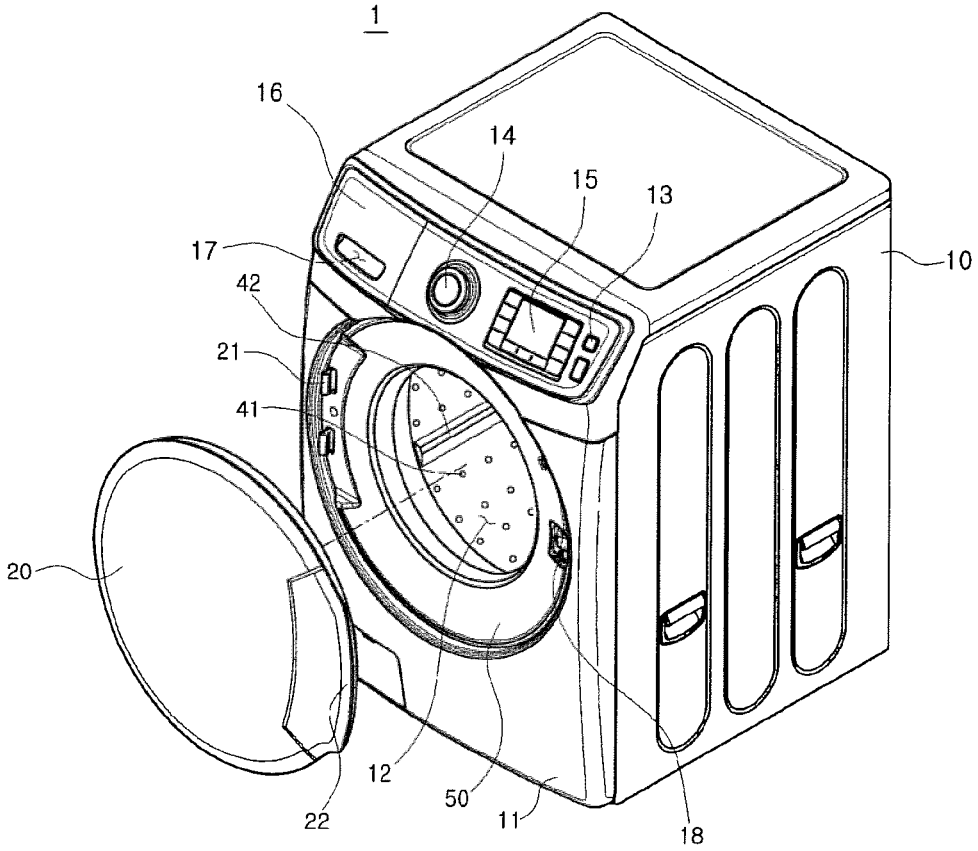

[Fig. 6]
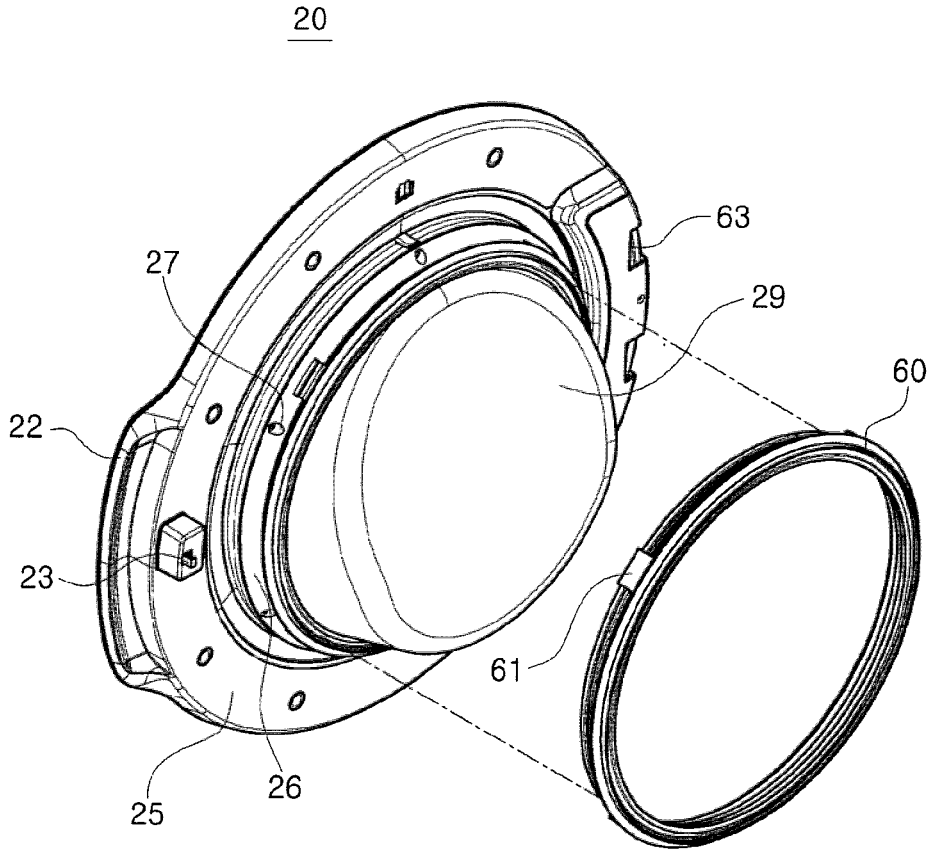

[Fig. 7]
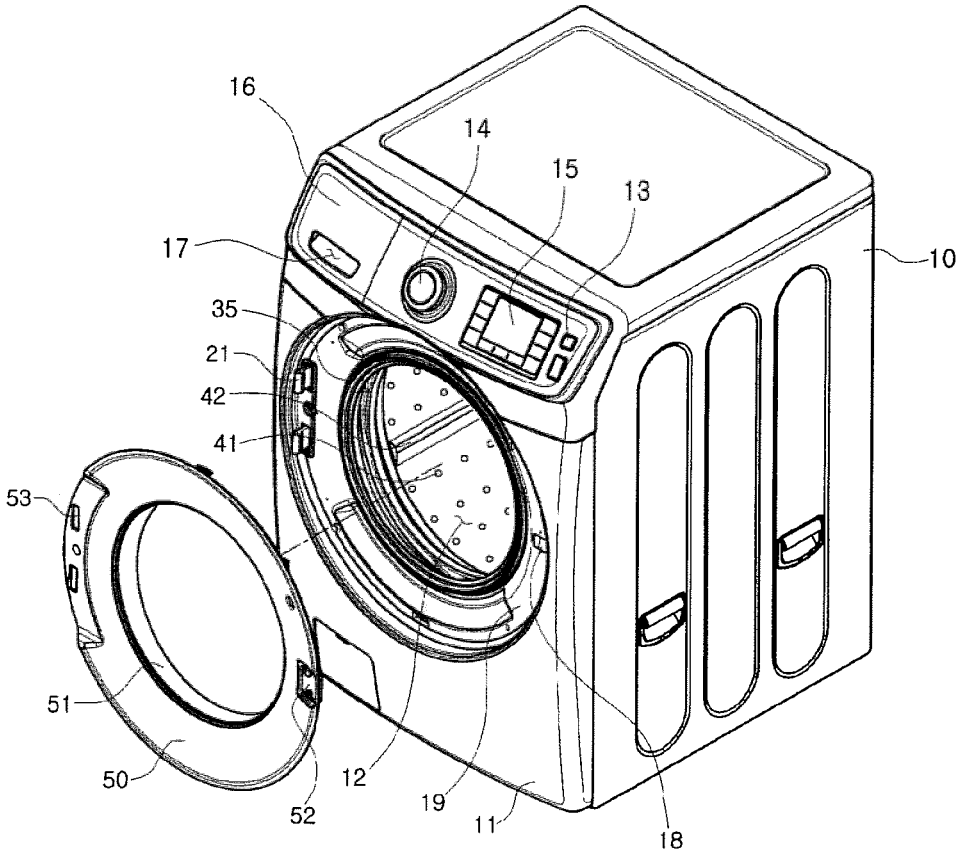

[Fig. 8]
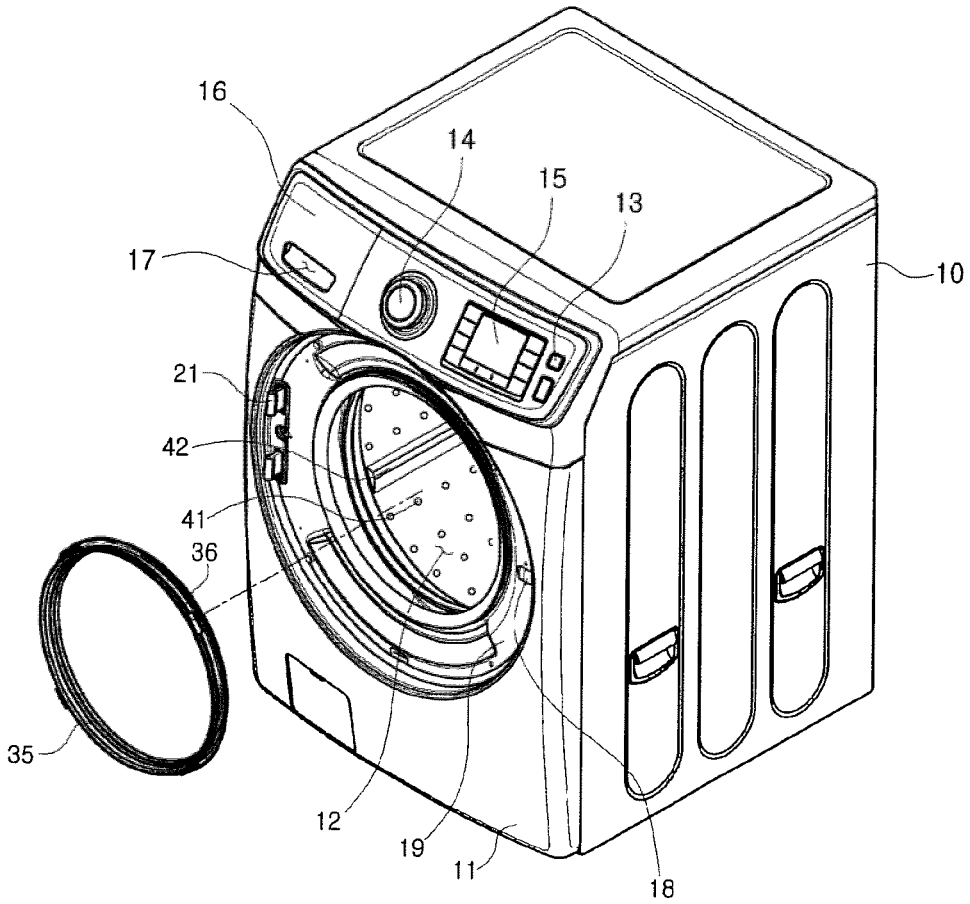

WASHING MACHINE

CROSS-REFERENCE TO RELATED APPLICATIONS

The present application claims priority under 35 U.S.C. § 365 to International Patent Application No. PCT/KR2015/008383 filed Aug. 11, 2015, entitled "WASHING MACHINE", and, through International Patent Application No. PCT/KR2015/008383, to Korean Patent Application No. 10-2014-0118853 filed Sep. 5, 2014, each of which are incorporated herein by reference into the present disclosure as if fully set forth herein.

TECHNICAL FIELD

The present disclosure relates to a washing machine, and more particularly, to a washing machine from which a diaphragm is removed.

BACKGROUND ART

A washing machine is an apparatus removing contaminants from laundry by using a detergent and water. Washing machines are classified into three types according to their washing method, agitator-type washing machines, vortex-type washing machines, and drum-type washing machines. In the agitator-type washing machines, clothes are washed by rotating an agitator protruding from the center of the bottom of a wash tub clockwise and counterclockwise. In the vortex-type washing machines, clothes are washed by using friction between the clothes and a water stream generated by rotating a disc-shaped pulsator mounted on the bottom of a rotary tub clockwise and counter-clockwise. In the drum-type washing machines, clothes are washed by adding water, a detergent, and the clothes into a drum having a plurality of lifters protruding from the inner circumferential surface thereof and rotating the drum.

Washing machines are also classified into top-loading washing machines and front-loading washing machines according to their shape. The top-loading washing machine is a washing machine into which laundry is put through an inlet provided at the top surface of the washing machine. The front-loading washing machine is a washing machine into which laundry is put through an inlet provided at the front surface of the washing machine. In general, the agitator-type and vortex-type washing machines are top-loading washing machines, and the drum-type washing machines are front-loading washing machines.

A drum-type washing machine may include a cabinet forming an external appearance of the washing machine, a tub disposed in the cabinet to contain wash water, and a rotary tub rotatably disposed in the tub. An inlet for insertion and removal of laundry is formed at a front side of the cabinet, and the inlet is opened and closed by a door coupled to the front side of the cabinet.

In general, a diaphragm that absorbs vibration of the tub and seals a gap between the tub and the cabinet is disposed between the tub and the cabinet. However, the diaphragm may get moldy since remaining wash water and foreign matter are introduced thereinto.

In addition, when the diaphragm is removed, a gap is formed between the tub and the cabinet, and thus laundry may fall into the gap between the tub and the cabinet during insertion and removal of the laundry. Also, the removal of the diaphragm may cause leakage of water and result in marring of the external appearance of the washing machine.

When the tub and the cabinet are disposed to be in contact with each other to remove the gap therebetween, the vibration of the tub may be transferred to the cabinet.

DISCLOSURE OF INVENTION

Technical Problem

An aspect of the present disclosure is to provide a washing machine from which a diaphragm is removed and in which sealing members are provided at a door and a main body.

Another aspect of the present disclosure is to provide a washing machine having an attractive appearance appealing to a user by applying a decorative panel to a front surface of a front panel.

Solution to Problem

In accordance with an aspect of the present disclosure, there is provided a washing machine including a cabinet, a front panel configured to form an appearance of a front surface of the cabinet, a tub disposed in the cabinet to contain wash water, a tub seal installed to prevent leakage of the wash water contained in the tub, and a decorative panel fixed to the front panel to prevent exposure of the tub seal through the front surface of the cabinet.

At least one portion of the decorative panel may be configured to cover the tub seal.

The tub seal may be disposed between the front panel and the tub.

The front panel may include an inlet for insertion and removal of laundry, and the washing machine may further include a door to open and close the inlet.

The decorative panel may be disposed between the front panel and the door.

The decorative panel may be formed along a circumference of the inlet.

The door may be rotatably coupled with the front panel and include a door seal fixed to the door to be rotated with the door.

The door seal may be pressed by the decorative panel to seal a gap between the front panel and the door.

The door may include a door seal configured to seal a gap between the front panel and the door.

The decorative panel may be disposed between the tub seal and the door seal.

When the door closes the inlet, the decorative panel may not be exposed through the front surface of the cabinet.

When the door opens the inlet, the decorative panel may form the appearance of the front surface of the cabinet.

The decorative panel may be mounted on the front surface of the front panel.

The front panel may include an inlet for insertion and removal of laundry, and the tub seal may be disposed at a circumference of the inlet.

One end of the decorative panel may be bent toward the inlet to prevent exposure of the tub seal through the front surface of the cabinet.

In accordance with another aspect of the present disclosure, there is provided a washing machine including a cabinet, a front panel disposed at one side of the cabinet and including an inlet, a door installed at the cabinet to open and close the inlet, and a decorative panel disposed between the front panel and the door and formed along a circumference of the inlet.

The decorative panel may be mounted on the front panel.

One end of the decorative panel adjacent to the inlet may be formed to be bent toward the inlet.

In accordance with another aspect of the present disclosure, there is provided a washing machine including a cabinet, a front panel configured to form one side of the cabinet and including an inlet, a door installed at the front panel to open and close the inlet, and a door seal installed at the door to seal a gap between the door and the front panel.

The washing machine may further include a tub disposed in the cabinet and a tub seal installed between the tub and the front panel.

The door seal and the tub seal may have separate sealing structures.

The door seal and the tub seal may be disposed not to be in contact with each other.

The door may be rotatably coupled to the front panel with the door seal, and the tub seal may be fixed between the tub and the front panel.

Advantageous Effects of Invention

The washing machine according to the present disclosure may have an attractive appearance appealing to a user by mounting a decorative panel on the front surface thereof to prevent exposure of a sealing structure.

In addition, remaining of wash water and fur and growth of mold caused thereby may be prevented by removing a diaphragm.

BRIEF DESCRIPTION OF DRAWINGS

FIG. 1 is a perspective view illustrating a washing machine according to an embodiment of the present disclosure;

FIG. 2 is a perspective view illustrating a washing machine according to an embodiment of the present disclosure in which a door is rotated;

FIG. 3 is a side cross-sectional view illustrating a washing machine according to an embodiment of the present disclosure;

FIG. 4 is an enlarged view illustrating a part of FIG. 3

FIG. 5 is an exploded view illustrating a washing machine in which a door is separated from a main body according to an embodiment of the present disclosure;

FIG. 6 is an exploded view illustrating a door of a washing machine according to an embodiment of the present disclosure;

FIG. 7 is an exploded view illustrating a main body of a washing machine according to an embodiment of the present disclosure; and FIG. 8 is an exploded view illustrating a main body of a washing machine according to an embodiment of the present disclosure.

BEST MODE FOR CARRYING OUT THE INVENTION

Hereinafter, embodiments of the present disclosure will be described in detail with reference to the accompanying drawings.

FIG. 1 is a perspective view illustrating a washing machine according to an embodiment of the present disclosure. FIG. 2 is a perspective view illustrating a washing machine according to an embodiment of the present disclosure in which a door is rotated.

Referring to FIG. 1, a washing machine 1 includes a cabinet 10 that forms an external appearance of the washing machine 1.

In addition, the washing machine 1 may include a front panel 11 disposed at one side of the cabinet 10. The front panel 11 may be disposed at the front surface of the cabinet 10 forming an appearance of the front surface of the washing machine 1. The front panel 11 may include an inlet 12 for insertion and removal of laundry.

In addition, the front panel 11 may include a power button 13, a manipulation unit 14, and a display unit 15. A user may turn on and off the washing machine 1 by using the power button 13. The manipulation unit 14 may have various forms such that the user selects a variety of modes of the washing machine 1. The display unit 15 may display an operation selected via the power button 13 and the manipulation unit 14 such that the user recognizes the selected operation.

The front panel 11 may further include a detergent compartment 16 through which a detergent is introduced by the user. The detergent compartment 16 may have a detergent compartment grip portion 17 at the front side thereof such that the user easily moves the detergent compartment 16.

In addition, the washing machine 1 may include a door 20 to open and close the inlet 12. The door 20 may be coupled to the cabinet 10 to open and close the inlet 12. Particularly, the door 20 may be disposed at one side of the front panel 11 having the inlet 12. The door 20 may be formed of a transparent material such that the user identifies the inside of the washing machine 1.

The door 20 may be rotatably coupled to the front panel 11 for easy insertion and removal of the laundry through the inlet 12 by the user. As illustrated in FIG. 2, the door 20 may be rotatable at a predetermined angle with respect to the front panel 11. FIG. 1 illustrates the door 20 that closes the inlet 12, and FIG. 2 illustrates the door 20 that opens the inlet 12.

The door 20 may be rotatably coupled with the front panel 11 via a hinge member 21. The hinge member 21 may be installed to couple the front panel 11 with the door 20. That is, the hinge member 21 may be configured to rotatably couple the door 20 with the front panel 11. The hinge member 21 may be fixed to the front panel 11 and rotatably coupled to one side of the door 20.

The hinge member 21 may include at least one material selected from the group consisting of metal such as stainless steel, aluminum, and engineering plastics. The front panel 11 may include a fixing bracket (not shown) such that the hinge member 21 is stably fixed to the front panel 11. However, FIG. 2 illustrates an example of the shape of the hinge member 21, and the hinge member 21 may have various other shapes.

The door 20 may have a hand grip portion 22 which may be gripped by the user to rotate the door 20. The hand grip portion 22 may be disposed at the opposite side of the door to the hinge member 21. Thus, the user may easily open and close the inlet 12 by rotating the door 20 while gripping the hand grip portion 22.

The door 20 may include door lock devices 18 and 23 to prevent the inlet 12 from being opened while performing a washing operation. The door lock devices 18 and 23 may be provided to fix the door 20 and the front panel 11. The door lock devices 18 and 23 may be disposed at the opposite side of the door 20 to the hinge member 21.

That is, the door lock devices 18 and 23 may be disposed adjacent to the hand grip portion 22. In this case, the hand grip portion 22 may be disposed at the front surface of the inlet 12 to open and close the inlet 12, and the door lock devices 18 and 23 may be disposed at the rear surface of the door 20 to be fixed to the front panel 11.

The door lock devices 18 and 23 may include a hook 23 installed at the door 20 and a hook recess 18 disposed at the front panel 11. The hook 23 may be installed in an elastically movable manner and detachably coupled to the hook recess 18. When a washing operation is started, the door 20 may be fixed to the front panel 11 by fixing the hook 23 to the hook recess 18.

In addition, a sealing structure to prevent leakage of water may be provided between the door 20 and the front panel 11. This will be described in more detail later.

FIG. 3 is a side cross-sectional view illustrating a washing machine according to an embodiment of the present disclosure. FIG. 3 schematically illustrates constituent elements of the washing machine for descriptive purpose. Referring to FIG. 3, the constituent elements of the washing machine will be briefly described.

The washing machine 1 may include a tub 30 disposed in the cabinet 10. The tub 30 may be installed to contain wash water.

In addition, a rotary tub 40 may be rotatably disposed in the tub 30. Laundry is introduced into the rotary tub 40 and washed. The rotary tub 40 may have a plurality of through holes 41 through which wash water flows. In addition, a plurality of lifters 42, by which laundry is raised and dropped when the rotary tub 40 is rotated, may be installed at the inner circumference thereof.

A water supply pipe 2 to supply wash water to the tub 30 is installed at an upper portion of the tub 30. One end of the water supply pipe 2 may be connected to an external water source (not shown), and the other end of the water supply pipe 2 may be connected to the detergent compartment 16. A water supply valve 3 may be installed at the water supply pipe 2 to control supply of water.

The detergent compartment 16 may be connected to the tub 30 via a connection pipe 4. Thus, water supplied through the water supply pipe 2 is supplied into the tub 30 along the connection pipe 4 together with the detergent via the detergent compartment 16.

A drain pump 5 and a drain pipe 6 to discharge water contained in the tub 30 out of the cabinet 10 are installed at a lower portion of the tub 30.

A damping member 7 that elastically supports the tub 30 may be disposed under the tub 30. The damping member 7 may be installed to connect an inner surface of the bottom of the cabinet 10 with an outer surface of the bottom of the tub 30. The damping member 7 may also be installed at an upper portion of the tub 30 to connect an inner surface of the top of the cabinet 10 with an outer surface of the top of the tub 30.

A motor 44 to rotate the rotary tub 40 may be installed at the rear surface of the tub 30. The motor 44 may be mounted on the rotary tub 40, and a drive shaft 45 of the motor 44 may be connected to the rotary tub 40. When the drive shaft 45 is driven by the motor 44, the rotary tub 40 connected to the drive shaft 45 is rotated about the drive shaft 45.

At the rear surface of the tub 30 is installed a bearing housing 46 to rotatably support the drive shaft 45. The bearing housing 46 may be formed of an aluminum alloy and may be inserted into a rear wall of the tub 30 when the tub 30 is injection molded. Bearings 45 may be installed between the bearing housing 46 and the drive shaft 45 to smoothly rotate the drive shaft 42.

During a washing cycle, the motor 44 rotates the rotary tub 40 in alternating directions at low speed. As a result, laundry contained in the rotary tub 40 is repeatedly raised and dropped thereby removing contaminants from the laundry. In a spin-dry cycle, the motor 44 rotates the rotary tub 40 in one direction at high speed thereby separating water from the laundry by centrifugal force applied to the laundry.

In this washing operation, wash water contained in the tub 30 may leak from the tub 30. The leakage of wash water may cause inconvenience to the user and damage components inside the washing machine 1. Furthermore, stagnant wash water therein may cause growth of mold, and the like. Thus, the washing machine 1 includes a sealing structure to prevent leakage of wash water.

The sealing structure may be provided at the tub 30 and the door 20, respectively. A sealing structure installed at the tub 30 is referred to as a tub seal 35, and a sealing structure installed at the door 20 is referred to as a door seal 60. That is, the door seal 60 and the tub seal 35 may have different sealing structures.

The tub seal 35 and the door seal 60 may have a ring shape with an open center. The tub seal 35 and the door seal 60 may be formed of an elastic material such as rubber and may be partially deformed to prevent leakage of wash water.

The tub seal 35 may be installed to prevent leakage of wash water contained in the tub 30. Particularly, the tub seal 35 may be disposed between the front panel 11 and the tub 30. The tub seal 35 may be formed along a circumference of the inlet 12 to seal a gap between the front panel 11 and the tub 30.

Also, the door seal 60 may be formed such that the door 20 closely contact with the front panel 11 to close the inlet 12. Particularly, the door seal 60 may be disposed between the front panel 11 and the door 20. The door seal 60 may be formed along a circumference of the inlet 12 to seal a gap between the front panel 11 and the door 20.

When the inlet 12 is opened by rotating the door 20, the tub seal 35 may be exposed at the front surface of the cabinet 10 resulting in marring of the external appearance of the washing machine 1. Thus, the washing machine 1 may include a decorative panel 50 to prevent exposure of the tub seal 35 through the front surface of the cabinet 10. When the inlet 12 is opened as illustrated in FIG. 2, the decorative panel 50 may faun a front external appearance of the cabinet 10.

FIG. 4 is an enlarged view illustrating a portion 'A' of FIG. 3. Referring to FIG. 4, the door seal 60, the tub seal 35, and the decorative panel 50 will be described in more detail.

As illustrated in FIG. 4, the decorative panel 50 may be disposed on the front panel 11. Particularly, the decorative panel 50 may be disposed between the front panel 11 and the door 20. Thus, when the door 20 closes the inlet 12, the decorative panel 50 may not be exposed through the front surface of the cabinet 10. When the door 20 opens the inlet 12, the decorative panel 50 may form the front external appearance of the cabinet 10.

The decorative panel 50 may be fixedly mounted on the front surface of the front panel. The decorative panel 50 may also be detachably mounted on the front panel 11 or separably installed thereon by using a screw, or the like.

In addition, as illustrated in FIG. 4, the tub seal 35 may be disposed between the decorative panel 50 and the tub 30. One end of the tub seal 35 may be fixed to the tub 30, and the other end thereof may be fixed to the front panel 11. The tub seal 35 may be pressed by the decorative panel 50 to prevent leakage of wash water contained in the tub 30.

At least one portion of the decorative panel 50 may cover the tub seal 35. Accordingly, the tub seal 35 may be pressed thereby as illustrated in FIG. 4. In addition, the decorative panel 50 may be disposed to be spaced apart from the tub seal 35.

The decorative panel 50 may have a ring shape formed along the circumference of the inlet 12. In addition, one end of the decorative panel 50 may be bent toward the inside of the inlet 12, thereby preventing exposure of the tub seal 35 through the front surface of the cabinet 10.

In addition, as illustrated in FIG. 4, the door seal 60 may be disposed between the door 20 and the decorative panel 50. One end of the door seal 60 may be fixed to the door 20 and may rotate together with the door 20. The door seal 60 may be pressed by the decorative panel 50, thereby sealing the inlet 12.

That is, the decorative panel 50 may be disposed between the tub seal 35 and the door seal 60. The door seal 60 and the tub seal 35 may be disposed not to be in contact with each other by the decorative panel 50. However, FIG. 4 illustrates an example of the shapes of the tub seal 35 and the door seal 60, and they may have various other shapes.

FIG. 5 is an exploded view illustrating a washing machine in which a door is separated from a main body according to an embodiment of the present disclosure. Hereinafter, the other part of the washing machine except for the door is referred to as the main body. FIG. 6 is an exploded view of the door, and FIGS. 7 and 8 are exploded views of the main body.

FIG. 6 is an exploded view illustrating the door of the washing machine according to an embodiment of the present disclosure.

The door 20 may include door glasses 24 and 29, an inner frame 25, and an outer frame 28 connected to the inner frame 25. The inner frame 25 may be disposed adjacent to the front panel 11. The door glasses 24 and 29 may include a front glass 24 and a rear glass 29 and may be formed of a transparent material.

The outer frame 28 and the inner frame 25 may be disposed to form an opening at the centers thereof. The front glass 24 is coupled to a front surface of the outer frame 28, and one side of the rear glass 29 may be coupled between the outer frame 28 and the inner frame 25.

The user may identify a state of the inside of the washing machine 1 while washing laundry through the opening formed by the outer frame 28 and the inner frame 25 and the door glasses 24 and 29 formed of the transparent material.

A hook 23 may be installed at one side of the inner frame 25. A hinge coupling groove 63 coupled with the hinge member 21 may be disposed at the opposite side thereof to the hook 23. One end of the hinge member 21 may be coupled to the hinge coupling groove 63.

The circumference of the rear glass 29 may be fixed between the inner frame 25 and the outer frame 28. A sealing fixing member 26 may be disposed along the circumference of the fixed rear glass 29. The sealing fixing member 26 may be integrally formed with the inner frame 25. In addition, as illustrated in FIGS. 4 and 6, the sealing fixing member 26 may be coupled to the inner frame 25 by using a screw 27 to be fixed thereto.

The door seal 60 may be coupled to the sealing fixing member 26 to be fixed to the door 20. The door seal 60 may include at least one door seal protrusion 61 inserted into and coupled to the sealing fixing member 26. As illustrated in FIG. 6, a plurality of the door seal protrusions 61 may protrude toward the sealing fixing member 26.

As described above, the door seal 60 moves with the door 20 in a fixed state to the door 20. The door 20 may efficiently close the inlet 12 by using the door seal 60.

FIG. 7 is an exploded view illustrating a main body of a washing machine according to an embodiment of the present disclosure. FIG. 7 illustrates that the decorative panel is separated from the main body illustrated in FIG. 5.

The front panel 11 may have a decorative panel mounting unit 19 on which the decorative panel 50 is mounted. The decorative panel mounting unit 19 may be disposed at a circumference of the inlet 12 to be recessed inward. The decorative panel mounting unit 19 may be integrally formed with the front panel 11. Thus, there are limitations on the shape of the decorative panel mounting unit 19, and the decorative panel mounting unit 19 may have an uneven surface caused during a manufacturing process.

When exposed to the outside, the decorative panel mounting unit 19 result in marring of the external appearance of the washing machine. Thus, the decorative panel 50 may be disposed on the front surface of the decorative panel mounting unit 19 thereby improving the external appearance of the washing machine 1.

The decorative panel 50 may be separably mounted on the decorative panel mounting unit 19 by using a screw, or the like. In addition, a structure corresponding to the decorative panel mounting unit 19 may be disposed at the rear surface of the decorative panel 50 such that the decorative panel 50 may be inserted into the decorative panel mounting unit 19.

The decorative panel 50 may have a ring shape and include a bent portion 51 at one end thereof adjacent to the inlet 12. The bent portion 51 may be bent toward the inlet 12. The bent portion 51 may be disposed such that the tub seal 35 disposed at a circumference of the inlet 12 is not exposed to the outside. That is, the bent portion 51 may be disposed adjacent to the inner surface of the tub seal 35.

In addition, the decorative panel 50 may have a hinge passing hole 53 through which the hinge member 21 passes. Thus, one end of the hinge member 21 may be fixed to the front panel 11, and the other end thereof may pass through the hinge passing hole 53 to be coupled to the door 20. Also, the decorative panel 50 may have a shape that passing the hinge member 21 without having the hinge passing hole 53

The decorative panel 50 may also have a hook passing hole 52 through which the hook 23 passes. Thus, one end of the hook 23 may be fixed to the door 20, and the other end thereof may pass through the hook passing hole 52 to be couple to the hook recess 18. In addition, the decorative panel 50 may have a shape that does passing the hook recess without having the hook passing hole 52.

Thus, FIG. 7 illustrates an example of the shape of the decorative panel 50, and the decorative panel 50 may also have various other shapes. Also, the decorative panel 50 may have various shapes with various materials improving the external appearance of the washing machine.

FIG. 8 is an exploded view illustrating a main body of a washing machine according to an embodiment of the present disclosure. FIG. 8 illustrates that the tub seal is separated from the main body from which the decorative panel is removed.

When the decorative panel 50 is separated from the main body as illustrated in FIG. 7, the tub seal 35 may be exposed to the outside. The tub seal 35 may be disposed at a circumference of the inlet 12. As illustrated in FIG. 4, one end of the tub seal 35 is fixed to the tub 30, and the other end thereof is fixed to the front panel 11.

The tub seal 35 is inserted and coupled between the tub 30 and the front panel 11. One end of each of the tub 30 and the front panel 11 is bent such that the tub seal 35 may be stably coupled to the tub 30 and the front panel 11.

In addition, the tub seal 35 may include at least one tub seal protrusion 36 inserted into the front panel 11 to be coupled thereto. As illustrated in FIG. 8, a plurality of tub seal protrusions 36 are disposed at a predetermined angle to protrude in one direction.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

The invention claimed is:

1. A washing machine comprising:

a cabinet;

a front panel configured to form an appearance of a front surface of the cabinet and including an inlet;

a tub disposed in the cabinet to contain wash water;

a tub seal installed to prevent leakage of the wash water contained in the tub; and a decorative panel formed along a circumference of the inlet, mounted to the front panel, and bent toward an inside of the inlet and cover the tub seal in a radial direction of the inlet to prevent exposure of the tub seal through the front surface of the cabinet, a door configured to open and close the inlet; and a door seal configured to seal a gap between the decorative panel and the door, wherein the decorative panel is disposed between the tub seal and the door seal when the door is closed.

2. The washing machine according to claim 1, wherein at least one portion of the decorative panel is configured to cover the tub seal.

3. The washing machine according to claim 1, wherein the tub seal is disposed between the front panel and the tub.

4. The washing machine according to claim 1, wherein the decorative panel is disposed between the front panel and the door.

5. The washing machine according to claim 4, wherein:

the door is rotatably coupled with the front panel, and the door seal is fixed to the door to be rotated with the door.

6. The washing machine according to claim 5, wherein the door seal is pressed by the decorative panel to seal the gap between the front panel and the door.

7. The washing machine according to claim 4, wherein when the door closes the inlet, the decorative panel is not exposed through the front surface of the cabinet.

8. The washing machine according to claim 4, wherein when the door opens the inlet, the decorative panel forms the appearance of the front surface of the cabinet.

9. The washing machine according to claim 1, wherein the decorative panel is mounted on a front surface of the front panel.

10. The washing machine according to claim 1, wherein:

the inlet is for insertion and removal of laundry, and the tub seal is disposed at the circumference of the inlet.

11. A washing machine comprising:

a cabinet;

a tub disposed in the cabinet to contain wash water;

a tub seal installed to prevent leakage of the wash water contained in the tub;

a front panel disposed at one side of the cabinet and comprising an inlet;

a door rotatably coupled to the front panel and configured to open and close the inlet;

a decorative panel mounted between the front panel and the door, formed along a circumference of the inlet, and bent toward an inside of the inlet and cover the tub seal in a radial direction of the inlet to prevent exposure of the tub seal through the front panel of the cabinet when the door is open; and a door seal configured to seal a gap between the decorative panel and the door, wherein the decorative panel is disposed between the tub seal and the door seal when the door is closed.

12. The washing machine according to claim 11, wherein the decorative panel is mounted on the front panel.

* * * * *